United States Patent [19]

Zambrano

[11] Patent Number: 4,509,976

[45] Date of Patent: Apr. 9, 1985

[54] PRODUCTION OF FERROBORON

[75] Inventor: Adolfo R. Zambrano, Hibbing, Minn.

[73] Assignee: Owens-Corning Fiberglas Corporation, Toledo, Ohio

[21] Appl. No.: 592,134

[22] Filed: Mar. 22, 1984

[51] Int. Cl.[3] ..... C22C 33/00

[52] U.S. Cl. ..... 75/21; 75/123 B; 75/129

[58] Field of Search ..... 75/21, 123 B, 129

[56] References Cited

U.S. PATENT DOCUMENTS

| | | | |
|---|---|---|---|
| 3,030,204 | 4/1962 | Staggers et al. | 75/129 |
| 4,197,218 | 4/1980 | McKaveney | 252/503 |
| 4,397,691 | 8/1983 | Hamada | 75/123 B |

*Primary Examiner*—Peter D. Rosenberg
*Attorney, Agent, or Firm*—Ronald C. Hudgens; Patrick P. Pacella

[57] ABSTRACT

A process for producing ferroborons is disclosed. The process consists of reacting a boron compound such as calcined colemanite with a metal such as aluminum in the presence of iron. The solid state reaction followed by subsequent grinding and sintering steps optimizes boron recovery.

20 Claims, 1 Drawing Figure

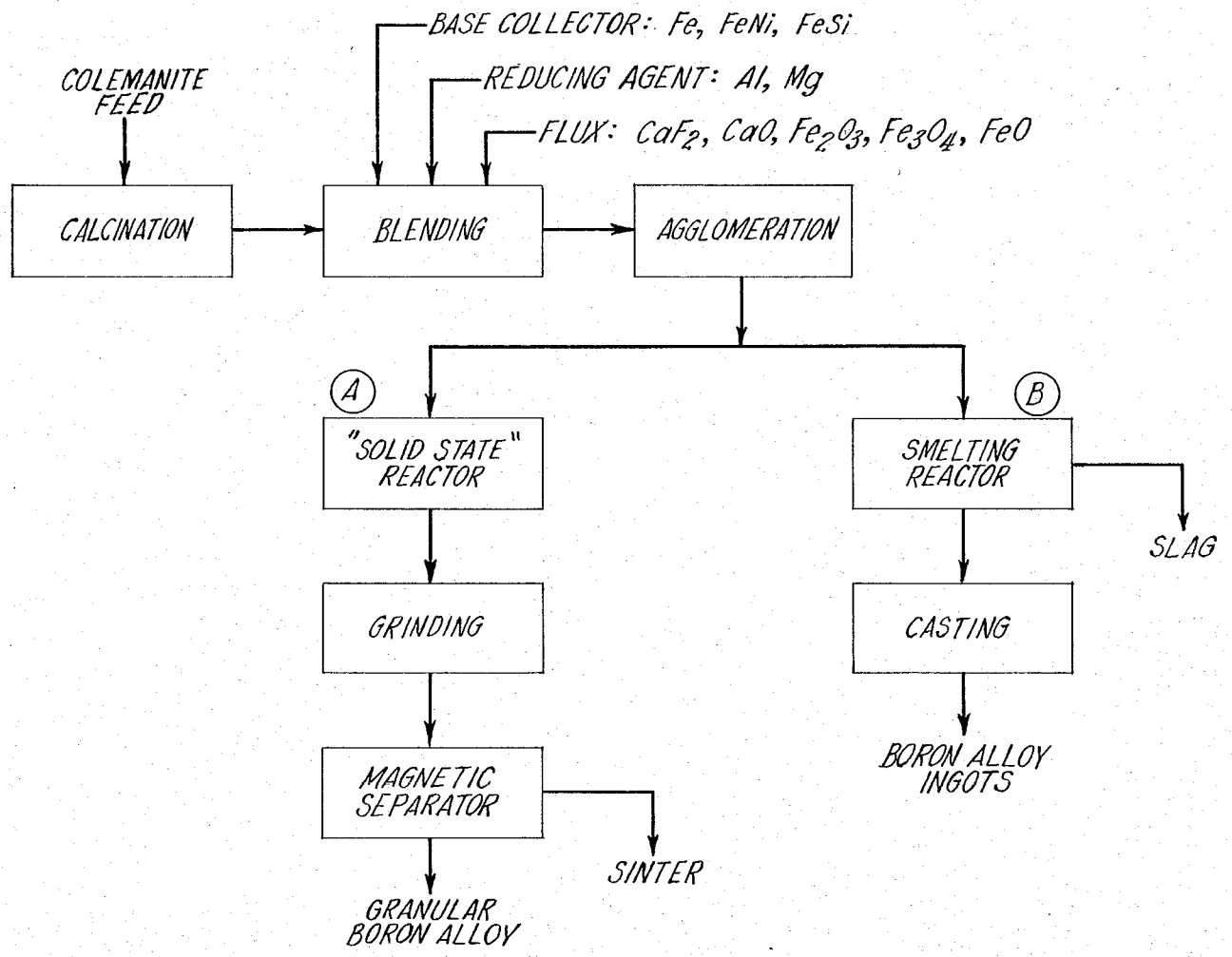
COLEMANITE FEED
CALCINATION
BASE COLLECTOR: Fe, FeNi, FeSi
REDUCING AGENT: Al, Mg
FLUX: $CaF_2$, CaO, $Fe_2O_3$, $Fe_3O_4$, FeO
BLENDING
AGGLOMERATION
A
"SOLID STATE" REACTOR
GRINDING
MAGNETIC SEPARATOR
SINTER
GRANULAR BORON ALLOY
B
SMELTING REACTOR
SLAG
CASTING
BORON ALLOY INGOTS

PRODUCTION OF FERROBORON

TECHNICAL FIELD

This invention relates to a process for producing ferroborons. In one embodiment, ferroboron is produced from colemanite or other borates.

BACKGROUND ART

Present technologies produce boron alloys by means of smelting processes that utilize either carbon or aluminum as the reducing agent for boron anhydride, $B_2O_3$. The rapidly expanding field is essentially associated with the development of amorphous metals having very low magnetic losses, with typical alloys being Fe—Ni—B and Fe—B—Si. These alloys find their applications in motor and transformer cores and the electronic industry in general.

The standard smelting processes for producing ferroboron alloys seem to have in common a low boron yield that perhaps reflects the relatively high cost of producing the alloy.

The normal starting material for producing ferroboron is boric acid which, upon dehydration, converts to boron anhydride, $B_2O_3$. This boron oxide is very stable and can be reduced to metallic boron with carbon, aluminum or magnesium.

Smelting is the general approach to ferroboron production, but process yields are only around 40%. Besides the yield drawback of present smelting practices, carbon reduction produces ferroboron containing approximately 2% carbon; aluminum reduction produces ferroboron containing approximately 1.5% aluminum; and magnesium reduction has inherent high magnesium losses and slag-metal separation difficulties.

DISCLOSURE OF INVENTION

In my scheme to ferroboron alloys production, I have taken an entirely different approach to lower the energy requirements and improve the overall boron yield. My process relies on solid state reactions among colemanite, aluminum and iron to generate primarily ferroborn sintered within a matrix of calcium aluminates. Liberation of the alloy from this matrix and subsequent smelting is seen as an alternative to present smelting practices.

The solid ferroboron is made at low temperatures by solid and liquid state reactions in order to save on energy. It takes advantage of the exothermic heat of reaction to the fullest. The subsequent smelting of the alloy requires, in general, energy only for a fraction of the total feed to the process. Another advantage is that my process does not require highly refined starting materials such as boric acid.

This process consists of reacting a borate with aluminum powder in the presence of iron powder to produce solid ferroboron alloys by solid and liquid state reactions in the temperature range from 700° to 1200° C. hereupon identified as "solid state reactions". Typical reactions are:

$$2CaO.3B_2O_3+6Al+6Fe \rightleftharpoons 6FeB+3Al_2O_3+2CaO$$

$$2CaO.3B_2O_3+9Mg+6Fe \rightleftharpoons 6FeB+2CaO+9MgO$$

When reducing borates with aluminum, the addition of CaO is beneficial in producing more desirable calcium aluminate species for the mineral processing of the calcine produced or the subsequent smelting of the total sintered mass.

The calcine produced is then crushed and ground to liberate the ferroboron alloys from the calcium aluminates. The ground calcine is then subjected to magnetic separation to recover a concentrate containing the boron-iron alloys. The tails are discarded. The granular magnetic concentrate is then smelted and refined to satisfy end use specifications. This is scheme A in the Figure.

Iron is used as collector for boron, and its proportion can be varied depending upon the grade of ferroalloy required. However, the proportion of iron may be adjusted in order not to sacrifice boron recovery. The aluminum requirement is, in general, 2.5 grams per gram boron present in the process feed as borates. However, the aluminum addition can be reduced in order to decrease the residual Al level in the FeB alloy or it can be increased to improve boron recovery. Instead of Fe as collector, $Fe_2O_3$ and/or $Fe_3O_4$ and/or FeO can be used with an attendant increase in Al and/or Mg requirements as reductants. The process then is carried out by direct smelting. This is also the case when CaO is added to adjust the $CaO\text{-}Al_2O_3$ ratio between 0.85 and 1.06. This is scheme B in the FIGURE.

The $B_2O_3$ may be supplied by many different borate compounds. The following is a list of some of the more readily available borate compounds:

| Mineral or Chemical Name | Chemical Formula |
|---|---|
| Boric acid | $H_3BO_3$ |
| Anhydrous boric acid | $B_2O_3$ |
| Anhydrous borax | $Na_2O.2B_2O_3$ |
| 5 Mol borax | $Na_2O.2B_2O_3.5H_2O$ |
| Borax | $Na_2O.2B_2O_3.10H_2O$ |
| Dehydrated Rasorite | $Na_2O.2B_2O_3$ |
| Probertite | $Na_2O.2CaO.5B_2O_3.10H_2O$ |
| Ulexite | $Na_22CaO.5B_2O_3.16H_2O$ |
| Colemanite | $2CaO.3B_2O_3.5H_2O$ |
| Calcined colemanite | $2CaO.3B_2O_3.H_2O$ |
| Sodium Perborate | $NaBO_2.H_2O_2.3H_2O$ |

Because of the disadvantages of relatively large amounts of water or soda in many of these compounds, ulexite, colemanite and especially calcined colemanite are preferred.

BRIEF DESCRIPTION OF THE DRAWING

The FIGURE shows a flow sheet of the process according to this invention.

BEST MODE OF CARRYING OUT INVENTION

Thermodynamic Properties

Colemanite is a mineral of composition $2CaO.3B_2O_3.5H_2O$ that upon calcination converts to $2CaO.3B_2O_3$.

The free energy and heat of formation of calcined colemanite were estimated as a linear combination of the properties of two other calcium borates as follows (Kcal):

| Species | $\Delta G_f 298$ | $\Delta H_f 298$ |
|---|---|---|
| $CaO.B_2O_3$ | −457.7 | −483.3 |
| $CaO.2B_2O_3$ | −752.4 | −798.8 |
| $2CaO.3B_2O_3$ | −1.210 | −1.282 |

Reduction by Aluminum $$2CaO.3B_2O_3 + 6Al \rightleftharpoons 2CaO + 3Al_2O_3 + 6B$$

$\Delta G = -213$ Kcal (Feasible)

-continued $\Delta H = -220$ Kcal (Exothermic)

The stoichiometric aluminum requirement is 2.5 units per unit weight of boron.

Reduction by Magnesium $2CaO.3B_2O_3 + 9Mg \rightleftarrows 9MgO + 2CaO + 6B$ $\Delta G = -303$ Kcal (Feasible)

$\Delta H = -386$ Kcal (Exothermic)

The stoichiometric magnesium requirement is 3.37 units per unit weight of boron.

Process Impact of Physical Properties

Some of the physical properties of elements and compounds of interest in the reduction of borates are given in Table 1. These properties, in general, will affect the efficiency of the reduction process, the selection of reductant and the choice of equipment to perform the reduction reaction.

To be sure, the presence of water, carbonates and air leakages in the system, for example, will oxidize more drastically Mg than Al. Carbonates will contribute to the level of carbon in the ferroboron alloy depending upon the temperature of reaction. The low melting temperature of colemanite, magnesium and aluminum will induce sintering which brings up the questions of choice between loose or briquetted feed and type of reactor. The low boiling point of magnesium adds to this metal total loss and to the careful design of equipment to prevent fire hazards.

The advantages of aluminum over magnesium concerning its reduced oxidation and volatization losses, and the more favorable stoichiometric requirements and slag characteristics. These facts determined our primary thrust in using aluminum as the reducing agent for colemanite and borates in general.

TABLE 1

SOME PHYSICAL PROPERTIES OF ELEMENTS AND COMPOUNDS OF INTEREST IN FERROBORON PRODUCTION

| Species | Process | Temperature, °C. |
|---|---|---|
| $2CaO.3B_2O_3.5H_2O$ | Dehydration | 315–405 |
| $2CaO.3B_2O_3$ | Fusion | 646 |
| $CaCO_3$ | Decomposition | 860–1,010 |
| $Mg_{(s)}$ | Fusion | 650 |
| $Mg_{(l)}$ | Boiling | 1,110 |
| $Al_{(s)}$ | Fusion | 660 |
| $Al_{(l)}$ | Boiling | 2,060 |

Ferroboron Test Procedures

The invention was designed according to the flowsheet shown in the FIGURE. The effort was concentrated on the "solid state" reaction scheme which is identified as branch A on the conceptual flowsheet.

The operating procedures of the "solid state" reaction were as follows:

Materials Specifications. The reduction process was carried out using calcined colemanite as process feed, aluminum powder as reducing agent and iron powder as the collector to form the ferroboron alloys.

The particle size of the calcined colemanite was essentially −65 mesh, and its chemical assays are given below.

| Sample: Calcined Colemanite Chemical Assay: Wt. % | | | | | | | |
|---|---|---|---|---|---|---|---|
| B | CaO | MgO | Fe | $SiO_2$ | $Al_2O_3$ | $CO_2$ | LOI |
| 13.39 | 35.1 | 0.34 | 0.16 | 1.27 | 0.16 | 12.46 | 12.60 |

The particle size of the aluminum powder was −325 mesh, and the iron powder was investigated in two particle size ranges: −100 mesh and −325 mesh.

The iron ore used for this purpose was the Carol Lake spiral concentrate, sample No. 82-6, ground to −150 mesh and having the following chemistry:

| | Assay: Wt. % | | | | | |
|---|---|---|---|---|---|---|
| Sample | $Fe_T$ | $SiO_2$ | $Al_2O_3$ | CaO | MgO | LOI |
| Carol Conc. | 66.18 | 4.35 | 0.13 | 0.14 | 0.4 | 0.32 |

The general procedures are as follows:

Loose Charges

1. The calcined colemanite is thoroughly blended with the required amounts of iron and aluminum powders. 2. The loose charges are placed in alumina crucibles and loaded inside the Pereny furnace which had been heated to the desired temperature.

3. After loading several crucibles, the furnace temperature is allowed to come back to the set point temperature. The reaction is then allowed to proceed for a specified length of time.

4. The reaction in step 3 is carried out either under a nitrogen or a $CO/CO_2$ atmosphere. A total gas flow of 7 lpm was used in all cases. For the tests under the reducing atmosphere, the gas was 70% CO and 30% $CO_2$.

5. At the end of the reaction period, the rucibles are transferred to a water cooled chamber flushed with 5 lpm nitrogen.

6. The cool reacted charge is crushed to −35 mesh and wet ground at 50% pulp density and 20% ball charge for a specified length of time. The slurry is filtered and the solution sampled for analysis. The filter cake is dried at 110° C. overnight.

7. The dried cake is broken down to −100 mesh and a sample of about 25 grams is taken using a mechanical splitter.

8. The 25-g sample is slurried and fed through a series arrangement of two magnetic separators. The first separator is a Davis Tube operating at 6,000 gauss while the second, a Carpco separator, is opeated at 10,000 gauss.

9. The magnetic and non-magnetic products are dried, pulverized and submitted for chemical and X-ray analyses.

10. A material balance on boron is calculated for each test.

Briquetted Charges

1. The calcined colemanite is thoroughly blended with the required amounts of iron and aluminum powders.

2. The blend is briquetted by applying a pressure of 30,000 psi in a single die mold.

3. The briquettes are then allowed to react using either the Pereny furnace, a rotary glass drum or an induction furnace.

4. The testing procedure is contined as in the case for loose charges.

Similar experimental procedures were followed for loose and briquetted charges when iron oxides and/or CaO were used as components of the blend.

The use of $Fe_2O_3$, and iron oxides in general, had the dual purpose of generating the metallic iron to collect the boron produced by aluminum reduction, as well as providing for some FeO to flux the slag to reasonable melting temperatures. The effect of CaO was to provide a fluxing action by shifting the CaO—$Al_2O_3$ ratio within the range of 0.85 to 1.1.

To carry out the ferroboron generating reactions, the reactors used were a muffle furnace for crucible test, a rotary glass drum to simulate the rotary kiln operation with briquetted charges and an induction furnace for the smelting of briquetted charges.

INDUSTRIAL APPLICABILITY

The following examples are given to illustrate the advantages of the invention but should not be construed as limiting in scope.

EXAMPLE SET 1

The effects of temperature and addition levels of Al and Fe on loose charges under a nitrogen atmosphere are summarized in Table 2. These data simply indicate that ferroboron alloys can be made at temperatures well below the fusion temperature of the slag forming constituents. Major constituents of the Davis Tube Concentrate, DTC, were FeB and $Fe_2B$.

EXAMPLE SET 2

These tests summarize the reduction performance of several borate species at high levels of iron addition under a nitrogen atmosphere. These tests were carried out on loose charges, and the results are given in Table 3.

EXAMPLE SET 3

These tests describe the reduction behavior of colemanite under a strongly reducing CO—$CO_2$ atmosphere at high levels of iron. The difference between a stagnant and a dynamic atmosphere is characterized by the results of crucibles and rotary glass drum respectively. The data are given in Table 4.

This data shows that because of the high oxygen affinity of aluminum, the use of even a reducing direct fired fossil fuel reactor is not possible, but external firing with an internal inert atmosphere remains a choice.

EXAMPLE SET 4

These tests describe the effects of temperature and the addition levels of Al, Fe and CaO under a reducing CO—$CO_2$ atmosphere. The high levels of iron produce 4 to 6% ferroboron alloys in the Davis tube concentrate, DTC. These data are given in Table 5.

EXAMPLE SET 5

These tests summarize the behavior of colemanite reduction with Mg under a reducing CO—$CO_2$ atmosphere in the presence of metallic iron or ferric iron oxide. For more efficient use of the Mg reductant, the reaction must be carried out in an inert atmosphere to avoid unnecessary Mg combustion. The experimental data are given in Table 6.

EXAMPLE SET 6

These tests describe the behavior of colemanite reduction by aluminum in the presence of ferric oxide and coal under a reducing CO—$CO_2$ atmosphere. The data are given in Table 7. These results indicate that the use of iron oxides requires the technique of direct smelting due to low melting point of the fluxed charge. The possibility of partially substituting aluminum with carbon is not a feasible approach.

EXAMPLE SET 7

These tests show the feasibility of ferroboron production from colemanite by direct smelting in the presence of iron oxides and/or calcium oxide under a nitrogen atmosphere. The data are shown in Table 8.

TABLE 2

FERROBORON FROM COLEMANITE USING LOOSE CHARGES
Tests Performed in Alumina Crucibles Reaction Time = 90 Minutes Atmosphere: Nitrogen (7 1 pm thru Pereney)
Colemanite Weight: 100 Grams

| Test No. | Temp., C | Reagents, Grams Al | Reagents, Grams Fe | Calcine Grams | MILL Volume, Liters | Magnetic Separation Wt. Dist.: % DTC | Magnetic Separation Wt. Dist.: % DTT | Boron Assays: gpl or Wt. % Solution | Boron Assays: gpl or Wt. % DTC | Boron Assays: gpl or Wt. % DTT | Boron Distribution: % Solution | Boron Distribution: % DTC | Boron Distribution: % DTT | Boron Accounted % |
|---|---|---|---|---|---|---|---|---|---|---|---|---|---|---|
| 2-1 | 732 | 45 | 40 | 182.3 | 1.5 | 42.11 | 57.89 | 0.1 | 11.9 | 5.6 | 1.79 | 59.64 | 38.57 | 108.5 |
| 2-2 | 800 | 40 | 30 | 162.87 | 1.6 | 31.38 | 68.62 | 0.1 | 7.47 | 6.4 | 2.32 | 33.99 | 63.69 | 79.5 |
| 2-3 | 800 | 50 | 30 | 183.21 | 1.3 | 36.21 | 63.79 | 0.13 | 9.50 | 6.4 | 2.20 | 44.72 | 53.08 | 99.64 |
| 2-3(1) | 800 | 50 | 30 | | | 41.73 | 20.36/37.91 | 0.13 | 5.12 | 6.55/4.52 | 3.16 | 39.92 | 24.91/32.01 | 69.07 |
| 2-4 | 800 | 40 | 50 | 187.6 | 1.5 | 47.66 | 52.34 | 0.11 | 6.82 | 6.08 | 2.50 | 49.27 | 48.23 | 86.36 |
| 2-5 | 800 | 50 | 50 | 201.4 | 1.7 | 48.72 | 51.28 | 0.13 | 5.75 | 5.28 | 3.85 | 48.89 | 47.26 | 80.83 |
| 2-6 | 900 | 36.6 | 40 | 170.5 | 1.9 | 32.36 | 67.64 | 0.10 | 14.9 | 4.48 | 2.36 | 59.96 | 37.68 | 96.98 |
| 2-7 | 900 | 53.41 | 40 | 192.0 | 1.8 | 33.62 | 66.38 | 0.04 | 11.4 | 5.76 | 0.93 | 49.59 | 49.48 | 105.51 |
| 2-8 | 900 | 45 | 21.83 | 164.3 | 1.9 | 51.50 | 48.50 | 0.08 | 10.2 | 4.32 | 2.03 | 70.04 | 27.93 | 87.32 |
| 2-9 | 900 | 45 | 56.82 | 201.0 | 1.2 | 30.72 | 69.28 | 0.07 | 9.73 | 5.6 | 1.21 | 42.99 | 55.80 | 99.21 |
| 2-10 | 900 | 45 | 40 | 176.33 | 1.9 | 45.37 | 54.63 | 0.09 | 10.2 | 4.8 | 2.30 | 62.36 | 35.34 | 92.5 |
| 2-11 | 900 | 45 | 40 | 177.18 | 1.5 | 33.37 | 66.63 | 0.06 | 10.4 | 4.96 | 1.31 | 50.55 | 48.14 | 86.39 |
| 2-12 | 900 | 45 | 40 | 177.3 | 1.7 | 35.20 | 64.70 | 0.09 | 9.97 | 4.32 | 2.37 | 54.35 | 43.28 | 80.94 |
| 2-13 | 900 | 45 | 40 | 177.0 | 2.0 | 33.62 | 66.38 | 0.05 | 10.4 | 4.8 | 1.47 | 51.55 | 46.98 | 85.2 |
| 2-14 | 900 | 45 | 40 | 177.47 | 1.6 | 46.50 | 53.50 | 0.06 | 10.2 | 3.84 | 1.39 | 68.80 | 29.81 | 86.85 |
| 2-15 | 900 | 45 | 40 | 177.75 | 1.6 | 42.43 | 57.57 | 0.08 | 9.5 | 4.16 | 1.95 | 61.50 | 36.55 | 82.5 |
| 2-16 | 1000 | 40 | 30 | 163.86 | 1.8 | 32.11 | 67.89 | 0.08 | 10.9 | 4.64 | 2.12 | 51.52 | 46.36 | 78.86 |
| 2-16(3) | | | | | 1.0 | 28.42 | —/71.58 | 0.11 | 11.8 | —/3.18 | 4.31 | 57.00 | 38.69 | 72.0 |
| 2-17 | 1000 | 50 | 30 | 174.42 | 1.5 | 33.05 | 66.95 | 0.05 | 8.14 | 4.96 | 1.23 | 44.20 | 54.57 | 75.42 |
| 2-18 | 1000 | 40 | 50 | 183.57 | 1.4 | 47.02 | 52.98 | 0.09 | 9.97 | 4.48 | 1.75 | 65.22 | 33.03 | 93.46 |
| 2-18(3) | | | | | 1.0 | 43.15 | —/56.85 | 0.11 | 10.10 | —/2.79 | 3.82 | 70.52 | 25.66 | 84.67 |

TABLE 2-continued

FERROBORON FROM COLEMANITE USING LOOSE CHARGES
Tests Performed in Alumina Crucibles Reaction Time = 90 Minutes
Atmosphere: Nitrogen (7 1 pm thru Pereney)
Colemanite Weight: 100 Grams

| Test No. | Temp., C | Reagents, Grams Al | Reagents, Grams Fe | Calcine Grams | MILL Volume, Liters | Magnetic Separation Wt. Dist.: % DTC | Magnetic Separation Wt. Dist.: % DTT | Boron Assays: gpl or Wt. % Solution | Boron Assays: gpl or Wt. % DTC | Boron Assays: gpl or Wt. % DTT | Boron Distribution: % Solution | Boron Distribution: % DTC | Boron Distribution: % DTT | Boron Accounted % |
|---|---|---|---|---|---|---|---|---|---|---|---|---|---|---|
| 2-19 | 1000 | 50 | 50 | 197.22 | 1.2 | 40.13 | 59.87 | 0.08 | 7.92 | 5.6 | 1.45 | 47.96 | 50.59 | 92.69 |
| 2-20 | 1068 | 45 | 40 | 178.66 | 1.5 | 41.17 | 58.8 | 0.05 | 9.88 | 4.10 | 1.14 | 62.06 | 36.80 | 83.21 |
| 2-21 | 1068(2) | 45 | 40 | 183.97 | 1.4 | 37.90 | 62.10 | 0.06 | 9.89 | 5.51 | 1.16 | 51.67 | 47.17 | 94.82 |
| 2-21 | 1068(1) | 45 | 40 | | 1.4 | 41.82 | 11.75/46.43 | 0.06 | 7.62 | 5.6/3.99 | 1.45 | 55.12 | 11.38/32.05 | 75.46 |

Notes:
(1)These calcines were reground and evaluated through a Davis Tube-Carpco separation. The figures under DTT separated by a slash actually represent the Carpco concentrate and tail respectively. Reground in 3" × 6" with 12% ball charge @ 50% pulp density for 15 minutes.
(2)Beginning with this test, the iron used as collector for boron was −100 mesh rather than −325 M previously used.
(3)Reground in 6" × 6" mill with 20% ball charge @ 50% pulp density for 15 minutes.
DTC = Davis Tube Concentrate
DTT = Davis Tube Tail

TABLE 3

FERROBORN FROM SEVERAL BORATES
Tests Performed in Alumina Crucibles Using Excess Iron Reaction Time = 90 Minutes
Charges: Loose
Atmosphere: Nitrogen
Borate Weight: 100 Grams

| Test No. | Temp., C | Reagents, Grams Al | Reagents, Grams Fe | Calcine Grams | MILL* Grind Solution, Liters | Magnetic Separation Wt. Dist.: % DTC | Magnetic Separation Wt. Dist.: % DTT | Boron Assays: gpl or Wt. % MILL Solution | Boron Assays: gpl or Wt. % DTC | Boron Assays: gpl or Wt. % DTT | Boron Distribution: % MILL Solution | Boron Distribution: % DTC | Boron Distribution: % DTT | Boron Accounted % |
|---|---|---|---|---|---|---|---|---|---|---|---|---|---|---|
| 3-22(1) | 900 | 45 | 100 | 238.7 | 3.5 | 80.63 | 19.37 | 0.04 | 5.18 | 3.56 | 2.80 | 83.43 | 13.77 | 83.96 |
| 3-23(1) | 900 | 45 | 150 | 290.53 | 2.2 | 84.09 | 15.91 | 0.06 | 4.28 | 2.72 | 3.17 | 86.44 | 10.39 | 84.64 |
| 3-24(2) | 900 | 45 | 150 | 275.44 | 2.4 | 82.80 | 17.20 | 0.4 | 3.41 | 1.78 | 23.47 | 69.04 | 7.49 | 81.19 |
| 3-25(3) | 900 | 45 | 150 | 280.46 | 2.2 | 76.04 | 23.96 | 0.07 | 3.84 | 3.23 | 4.00 | 75.89 | 20.11 | 98.22 |

Notes:
(1)Tests 3-22 and 3-23 were run using 100-g colemanite analyzing 14.0% boron.
(2)Test 3-24 was run using 100-g $Na_2B_4O_7.10H_2O$ analyzing 11.8% boron.
(3)Test 3-25 was run using 100-g probertite analyzing 10.7% boron. Significant swelling of the charge occured.
*Calcines were actually ground in 6" × 6" mill with 20% ball charge @ 50% pulp density for 30 minutes.
DTC = Davis Tube Concentrate
DTT = Davis Tube Tail

TABLE 4

FERROBORON FROM COLEMANITE

Reaction Time = 90 Minutes
Atmosphere: 70% CO & 30% $CO_2$
Colemanite Weight: 100 grams

| Test No. | Temp., °C. | Reagents, Grams Al | Reagents, Grams Fe | Calcine Grams | MILL* Grind Volume, Liters | Magnetic Separation Wt. Distribution: % DTC | Magnetic Separation Wt. Distribution: % Carpco Conc. | Magnetic Separation Wt. Distribution: % Carpco Tail | Boron Assays: gpl or Wt. % MILL Sol. | Boron Assays: gpl or Wt. % DTC | Boron Assays: gpl or Wt. % Carpco Conc. | Boron Assays: gpl or Wt. % Carpco Tail | Boron Distribution: % MILL Sol. | Boron Distribution: % DTC | Boron Distribution: % Carpco Conc. | Boron Distribution: % Carpco Tail | Boron Accounted % |
|---|---|---|---|---|---|---|---|---|---|---|---|---|---|---|---|---|---|
| A. Loose Charges Reacting in Crucibles. | | | | | | | | | | | | | | | | | |
| 4-26 | 800(1) | 35 | 100 | 230.48 | 1.4 | 78.26 | 7.39 | 14.35 | 0.14 | 5.54 | 5.95 | 1.42 | 3.79 | 83.78 | 8.50 | 3.93 | 83.36 |
| 4-26 | 800(6) | | | | 2.4 | 65.44 | 0.39 | 34.17 | 0.14 | 5.26 | | 4.87 | 6.15 | 63.39 | | 30.46 | 86.80 |
| 4-27 | 800(1) | 40 | 100 | 235.4 | 1.2 | 83.46 | 7.87 | 8.67 | 0.08 | 5.54 | 5.95 | 2.09 | 1.79 | 86.12 | 8.72 | 3.37 | 89.35 |
| 4-28 | 900 | 35 | 100 | 233.41 | 1.45 | 66.39 | 0.52 | 33.09 | 0.14 | 5.44 | | 4.50 | 3.96 | 70.97 | | 25.07 | 83.57 |
| 4-29 | 900 | 40 | 100 | 240.1 | 1.0 | 63.35 | 0.49 | 36.16 | 0.13 | 4.94 | | 3.93 | 2.76 | 67.03 | | 30.21 | 79.39 |
| 4-30 | 900(2) | 40 | 100 | 229.96 | 1.15 | 62.38 | 1.25 | 36.37 | 0.06 | 4.60 | | 5.49 | 1.38 | 58.63 | | 39.99 | 81.36 |
| 4-31 | 800(3) | 35 | 100 | 228.08 | 1.1 | 40.99 | 0.46 | 58.55 | 0.11 | 0.88 | | 7.19 | 2.54 | 9.13 | | 88.33 | 76.54 |
| 4-32 | 800 | 40 | 100 | 238.47 | 1.15 | 63.84 | 0.46 | 35.7 | 0.13 | 4.54 | | 3.90 | 3.35 | 65.44 | | 31.21 | 74.5 |
| B. Briquetted Charges Reacting in Rotary Glass Drum, RGD. | | | | | | | | | | | | | | | | | |
| 4-7(4) | 800 | 40 | 100 | 234.61 | 4.6 | 41.20 | 12.54 | 46.26 | 0.07 | 1.84 | 5.99 | 5.47 | 7.4 | 17.07 | 17.29 | 58.24 | 72.8 RGD |
| 4-8(4) | 900 | 40 | 100 | 233.91 | 3.1 | 37.67 | 1.09 | 61.24 | 0.15 | 1.26 | | 4.83 | 11.89 | 12.49 | | 75.62 | 63.63 RGD |
| C. Test to Elucidate Behavior of Section B Above, Uring Briquettes in Crucibles & Rotary Drum. | | | | | | | | | | | | | | | | | |
| 4-47(5) | 900 | 40 | 100 | 252.38 | | 85.60 | 0.42 | 13.98 | | 4.97 | | 2.57 | | 92.25 | | 7.75 | 83.55 |
| 4-47(6) | | | | | 2.6 | 59.98 | 0.52 | 39.50 | 0.14 | 5.09 | | 4.16 | 7.2 | 60.33 | | 32.47 | 87.26 |
| 4-9(5) | 900 | 40 | 100 | 232.0 | | 76.21 | 0.51 | 23.28 | | 4.61 | | 4.30 | | 77.94 | | 22.06 | 75.20 |

TABLE 4-continued

FERROBORON FROM COLEMANITE

Reaction Time = 90 Minutes

Atmosphere: 70% CO & 30% $CO_2$
Colemanite Weight: 100 grams

| Test No. | Temp., °C. | Reagents, Grams Al | Reagents, Grams Fe | Calcine Grams | MILL* Grind Volume, Liters | Magnetic Separation Wt. Distribution: % DTC | Carpco Conc. | Carpco Tail | Boron Assays: gpl or Wt. % MILL Sol. | DTC | Carpco Conc. | Carpco Tail | Boron Distribution: % MILL Sol. | DTC | Carpco Conc. | Carpco Tail | Boron Accounted % |
|---|---|---|---|---|---|---|---|---|---|---|---|---|---|---|---|---|---|
| 4-9(6) | | | | | 7.5 | 42.07 | 0.62 | 57.31 | 0.07 | 2.18 | | 6.41 | 10.24 | 18.14 | | 71.62 | 80.05 RGD |

Notes:
(1)Heat of reaction temporarily overheated calcine to 1000° C. (2 minutes).
(2)Test reaction time was 15 minutes.
(3)Charge reacted partially.
(4)Calcines were ground in 6" × 3" steel mill with 12% ball charges @ 50% pulp density for 30 minutes.
(5)Calcines were dry ground in Shatterbox.
(6)Calcines were reground in 6" × 6" steel mill with 20% ball charge @ 25% pulp density for 15 minutes.
*Calcines were generally ground in 6" × 6" steel mill with 20% ball charge @ 50% pulp density for 30 minutes
DTC = Davis Tube Concentrate

TABLE 5

FERROBORON FROM COLEMANITE WITH CaO ADDITION

Reaction Time = 90 Minutes
Charges: Loose

Atmosphere: 70% CO & 30% $CO_2$
Colemanite Weight: 100 grams

| Test No. | Temp., °C. | Reagents, Grams Al | Reagents, Grams Fe | Reagents, Grams CaO | Calcine Grams | MILL* Grind Volume, Liters | Magnetic Separation Wt. Distribution: % DTC | CARPCO Conc. | CARPCO Tails | Boron Assays: gpl or Wt. % MILL Sol. | DTC | CARPCO Conc. | CARPCO Tail | Boron Distribution: % MILL Sol. | DTC | CARPCO Conc. | CARPCO Tail | Boron Accounted % |
|---|---|---|---|---|---|---|---|---|---|---|---|---|---|---|---|---|---|---|
| 5-39 | 900 | 35 | 75 | 23 | 229.60 | 1.3 | 50.63 | 0.74 | 48.63 | 0.06 | 5.75 | — | 4.85 | 1.45 | 54.80 | — | 43.75 | 87.19 |
| 5-40 | 900 | 35 | 100 | 23 | 255.78 | 1.3 | 54.75 | 0.76 | 44.49 | 0.07 | 4.58 | — | 5.27 | 1.83 | 51.07 | — | 47.10 | 89.94 |
| 5-41 | 900 | 40 | 75 | 35 | 261.17 | 1.0 | 61.34 | 0.08 | 38.58 | 0.03 | 4.58 | — | 3.76 | 0.7 | 65.52 | — | 33.78 | 79.75 |
| 5-42 | 900 | 40 | 100 | 35 | 281.67 | 1.4 | 63.87 | 0.39 | 35.74 | 0.04 | 4.29 | — | 4.17 | 1.31 | 64.06 | — | 34.63 | 85.85 |
| 5-43 | 1000 | 35 | 75 | 23 | 241.28 | 1.2 | 43.67 | 0.35 | 55.98 | 0.16 | 5.02 | — | 4.59 | 3.88 | 44.45 | — | 51.67 | 83.74 |
| 5-44 | 1000 | 35 | 100 | 23 | 266.39 | 1.2 | 59.13 | — | 40.87 | 0.17 | 4.88 | — | 4.85 | 4.03 | 56.89 | — | 39.08 | 94.08 |
| 5-45 | 1000 | 40 | 75 | 35 | 262.08 | 1.0 | 44.59 | 0.06 | 55.35 | 0.18 | 4.73 | — | 4.76 | 3.65 | 42.87 | — | 53.48 | 90.14 |
| 5-46 | 1000 | 40 | 100 | 35 | 284.12 | 1.2 | 49.98 | 0.22 | 49.8 | 0.12 | 4.15 | — | 5.53 | 2.89 | 41.82 | — | 55.29 | 99.20 |

*Calcines were actually ground in 6" × 6" steel mill with 20% ball charge @ 50% pulp density for 30 minutes.
DTC = Davis Tube Concentrate

TABLE 6

FERROBORON FROM COLEMANITE MAGNESIUM REDUCTION(1)

Reaction Time = 90 Minutes
Charges: Loose

Atmosphere: 70% CO & 30% $CO_2$

| Test No. | Temp., °C. | Reagents, Grams Mg | Reagents, Grams Fe | Reagents, Grams Carol Conc. | Calcine Grams | MILL* Grind Volume Liters | Magnetic Separation Wt. Distribution: % DTC | Carpco Conc. | Carpco Tail | Boron Assays: gpl or Wt. % MILL Sol | DTC | Carpco Conc. | Carpco Tail | Boron Distribution: % MILL Sol. | DTC | Carpco Conc. | Carpco Tail | Boron Accounted % |
|---|---|---|---|---|---|---|---|---|---|---|---|---|---|---|---|---|---|---|
| 6-48 | 900 | 47.2 | 100 | — | 263.06 | 1.2 | 49.44 | — | 50.56 | 0.22 | 2.77 | — | 3.81 | 7.42 | 38.47 | — | 54.11 | 63.8 |
| 6-49(2) | 900 | 56.5 | — | 75 | 162.6? | 1.0 | 65.20 | — | 34.8 | 0.11 | 3.55 | — | 2.40 | 3.38 | 71.00 | — | 25.62 | 74.74 |
| 6-50(3) | 900 | 64.0 | — | 60 | 174.34? | 1.0 | 61.86 | — | 38.14 | 0.15 | 5.42 | — | 2.32 | 3.42 | 76.41 | — | 20.17 | 67.30 |

NOTES:
(1)A very violent reaction developed, more likely as a result of the reaction between Mg, $Fe_2O_3$ and the $CO/CO_2$ atmosphere. The crucibles were shattered and a satisfactory recovery of the calcines was not possible, especially for tests 6-49 and 50.
(2)Colemanite weight was 50 grams rather than the standard 100 grams.
(3)Colemanite weight was 80 grams rather than the standard 100 grams.
*Calcines were actually ground in a 6" × 6" steel mill with 20% ball charge @ 50% pulp density for 30 minutes.
DTC = Davis Tube Concentrate

TABLE 7

FERROBORON FROM COLEMANITE IN THE PRESENCE OF IRON OXIDES & COAL

Reaction Time = 60 Minutes

Atmosphere: 70% CO & 30% $CO_2$
Colemanite Weight: 100 Grams

| Test No. | Temp., °C. | Reagents, Grams: Al | Carol Conc | Colombian Coal | Calcine Grams | MILL* Grind Volume Liters | Magnetic Separation Wt. Distribution: % DTC | Carpco Conc. | Tail | Boron Assays: gpl or Wt. % MILL Sol. DTC | Carpco Conc. | Tail | Boron Distribution: % MILL Sol. DTC | Carpco Conc. | Tail | Boron Accounted % |
|---|---|---|---|---|---|---|---|---|---|---|---|---|---|---|---|---|
| A. Loose charge of feed blend was reacted in the Pereney furnace using open crucibles. | | | | | | | | | | | | | | | | |
| 7-33 (90 Min.) | 900(1) | 83.5 | 150 | — | Lost (Test was lost due to broken crucible by violent reaction.) | | | | | | | | | | | |
| 7-34 (90 Min.) | 900(1) | 59.0 | 75.0 | — | 221.0 | 1.25 | 30.10 | — | 69.9 | 0.10 11.0 | — | 2.04 | 2.57 68.10 | — | 29.33 | 75.7 |
| B. Briquetted charge of feed blend was reacted in the Pereney furnace using open crucibles. Only a fraction of the blend was used. | | | | | | | | | | | | | | | | |
| 7-35 | 900(1) | 83.5 | 150 | — | Lost | | | | | | | | | | | |
| | | | Met-al | But-ton | 98.4 | | | | | 7.82 | | | 55.00 | | | |
| 7-36 | 900 | 59 | 75 | — | 164.41 | 1.68 | 8.39 | — | 91.61 | 0.10 7.66 | — | 2.00 | 1.52 9.6 | | 27.36 | 78.64 |
| | | | Met-al | But-ton | 56.54 | | 95.39 | — | 4.61 | 12.10 | — | 9.45 | 59.28 | — | 2.24 | |
| | | | | | | | | | | Overall Recoveries | | | 1.52 68.88 | | 29.6 | |
| 7-37 | 900 | 35 | 150 | 45 | 261.85 | 2.2 | 14.85 | — | 85.15 | 0.08 2.75 | — | 5.88 | 3.15 7.3 | — | 89.55 | 102.5 |
| 7-38 | 900 | 35 | 75 | 22.5 | 202.28 | 1.9 | 31.98 | 5.2 | 62.82 | 0.14 7.33 | — | 3.91 | 4.88 50.03 | — | 45.09 | 76.8 |

NOTES:
(1)The thermite reaction was quite violent, resulting in fusion of the charge and loss of Test 7-33 and 35 due to reacted crucible.
*Calcines were ground in the 6" × 6" steel mill with 20% ball charge @ 50% pulp density for 30 minutes.
DTC = Davis Tube Concentrate

TABLE 8

FERROBORON BY DIRECT SMELTING

Atmosphere: Nitrogen

| Test No. | Temp., °C. | Blend: Colemanite | Al | Fe | Carol Conc. | CaO | $CaF_2$ | Products: Name | Amount Grams | Wt. Distribution % | Assays: gpl or Wt. % B | Al | Boron Distribution % | Boron Accounted % |
|---|---|---|---|---|---|---|---|---|---|---|---|---|---|---|
| 8-1(1) | 1650 | 40 | 20 | 20 | — | — | 20 | Calcine | 88.7 | | | | | |
| | | | | | | | | DTC | | 43.94 | 10.9 | — | 75.9 | |
| | | | | | | | | DTT | | 56.06 | 2.08 | — | 18.5 | |
| 8-2(1) | 1650 | 40 | 20 | 20 | — | 20 | 20 | | | | | | | |
| | | | | | | | | DTC | | 39.74 | 10.4 | — | | |
| | | | | | | | | CTT | | 60.26 | 2.08 | — | | |
| 83(2) | 1650 | (Composite of DTC from Tests 2-6 thru 21) | | | | | | HD. Compo | 52.9 | 100.0 | 8.93 | 0.64 | | |
| | | | | | | | | Met. Button | | | 13.3 | | | |
| 8-4(3) | 1350 | 100 | 83.5 | — | 150 | — | — | Calcine | 367.04 | | | | | |
| | | | | | | | | Met. Button | 109.39 | 29.8 | 7.31 | 7.09 | 59.69 | 94.8 |
| | | | | | | | | DTC | | 3.43 | 2.46 | | 2.31 | |
| | | | | | | | | Carpco Tail | | 66.76 | 2.01 | | 36.78 | |
| | | | | | | | | Grind Vol. | 1.5(1) | | 0.03 | | 1.22 | |
| 8-5(3) | 1600 | 100 | 35 | 75 | — | 23 | — | Calcine | 294.18 | | | | | 100.3 |
| | | | | | | | | Met. Button | 80.12 | 27.24 | 10.8 | 0.265 | 61.43 | |
| | | | | | | | | DTC | | 2.62 | 7.56 | | 4.14 | |
| | | | | | | | | Carpco Tail | | 70.14 | 2.32 | | 33.98 | |
| | | | | | | | | Grind Vol. | 1.1(1) | | 0.02 | | 0.45 | |

NOTES:
(1)Attempts to smelt without the use of CaO and/or FeO. The charges showed signs of incipient fusion but the crucibles broke and tests were lost. Partial evaluation was done to get an indication of possible recovery.
(2)This was an attempt to smelt a Davis Tube concentrate composite. A metal bottom was recovered but the charge did not melt and the crucible was destroyed by heat & chemical reation.
(3)These were smelting tests using fluxes to drop the melting point of the slag. A double crucible arrangement was used in these tests in an effort to obtain a material balance.
DTC = Davis Tube Concentrate
DTT = Davis Tube Tail

I claim:

1. A process for producing ferroboron including the step of reducing borate compounds with a material selected from the group consisting of uncombined aluminum, aluminum oxide, uncombined magnesium, and magnesium oxide in the presence of iron under an inert atmosphere at temperatures below the fusion temperature of slag forming constituents.

2. A process according to claim 1 wherein the reaction is carried out at temperatures ranging from 700° to 1200° C.

3. A process according to claim 1 wherein the reaction is carried out at 950° C.

4. A process according to claim 1 wherein the borates compounds are calcium borates.

5. A process according to claim 1 wherein the borate compounds are colemanite or calcined colemanite.

6. A process for producing ferroboron including the step of reducing calcium borates with aluminum powder in the presence of iron or iron oxide powders under an inert atmosphere at temperatures below the fusion temperature of slag forming constituents.

7. A process according to claim 6 wherein the reaction is carried out at 950° C.

8. A process according to claim 6 wherein the reaction is carried out with the addition of calcium oxide.

9. A process according to claim 6 wherein the calcium borates are colemanite or calcined colemanite.

10. A process according to claim 6 wherein the resulting products are crushed and ground to aid in the separation of the resulting ferroboron and resulting calcium aluminate.

11. A process according to claim 9 wherein the ground products are subjected to magnetic separation and the magnetic concentrate is smelted.

12. A process according to claim 6 wherein the reaction is carried out at temperatures ranging from 700° to 1200° C.

13. A process according to claim 6 wherein the inert atmosphere is nitrogen or argon.

14. A process according to claim 1 wherein the solid state reactions are represented by the equation: $2CaO.3B_2O_3+6Al+6Fe \rightleftarrows 6FeB+3Al_2O_3+2CaO$.

15. A process according to claim 1 wherein the solid state reactions are represented by the equation: $2CaO.3B_2O_3+9Mg+6Fe \rightleftarrows 6FeB+2CaO+9MgO$.

16. A process according to claim 8 wherein the resulting reacted solid mass is heated to 1600° C. to produce a gravity separation of liquid ferroboron alloy from molten slag.

17. A process according to claim 8 wherein the calcium oxide addition is made in order to produce a $CaO—Al_2O_3$ ratio in the range of 0.85 to 1.1 and preferably around 0.85.

18. A process according to claim 8 wherein the calcium borates may contain calcium carbonates.

19. A process according to claim 16 wherein the aluminum content of the ferroboron is minimized by increasing the contacting surface area between the molten ferroboron and slag by induction stirring.

20. A process according to claim 19 wherein the control of residual aluminum can be supplemented by making the slag slightly oxidizing with the addition of $Fe_2O_3$ in the final stages of smelting.

* * * * *